US008330622B2

(12) United States Patent
Stählin

(10) Patent No.: US 8,330,622 B2
(45) Date of Patent: Dec. 11, 2012

(54) TRAFFIC GUIDANCE SYSTEM

(75) Inventor: Ulrich Stählin, Eschborn (DE)

(73) Assignee: Continental Teves AG & Co. oHG, Frankfurt (DE)

( * ) Notice: Subject to any disclaimer, the term of this patent is extended or adjusted under 35 U.S.C. 154(b) by 335 days.

(21) Appl. No.: 12/674,246

(22) PCT Filed: Aug. 15, 2008

(86) PCT No.: PCT/EP2008/060779

§ 371 (c)(1),
(2), (4) Date: Feb. 19, 2010

(87) PCT Pub. No.: WO2009/027253

PCT Pub. Date: Mar. 5, 2009

(65) Prior Publication Data

US 2011/0187560 A1 Aug. 4, 2011

(30) Foreign Application Priority Data

Aug. 30, 2007 (DE) ..... 10 2007 041 359
Aug. 15, 2008 (DE) ..... 10 2008 037 883

(51) Int. Cl.
*G08G 1/095* (2006.01)

(52) U.S. Cl. ..... 340/907; 340/905; 340/917

(58) Field of Classification Search ..... 340/901–907, 340/943, 693.3, 988, 933, 435, 909, 910, 340/915–917; 701/117
See application file for complete search history.

(56) References Cited

U.S. PATENT DOCUMENTS

| | | | | |
|---|---|---|---|---|
| 5,572,201 | A * | 11/1996 | Graham et al. | 340/902 |
| 6,034,609 | A * | 3/2000 | Comiskey, Jr. | 340/631 |
| 6,317,058 | B1 | 11/2001 | Lemelson et al. | |
| 2003/0063015 | A1 | 4/2003 | Ebner et al. | |

FOREIGN PATENT DOCUMENTS

| | | | |
|---|---|---|---|
| DE | 101 42 250 | A1 | 4/2003 |
| DE | 10 2004 002 808 | A1 | 9/2004 |
| DE | 10 2004 028 656 | A1 | 2/2006 |
| DE | 10 2004 039 854 | A1 | 3/2006 |
| DE | 10 2005 053 461 | A1 | 5/2007 |
| DE | 10 2008 005 004 | A1 | 7/2008 |
| DE | 10 2007 000 634 | B3 | 4/2009 |
| EP | 1 628 276 | A2 | 2/2006 |

* cited by examiner

*Primary Examiner* — Anh V La
(74) *Attorney, Agent, or Firm* — RatnerPrestia

(57) ABSTRACT

Traffic light installations for producing meta information on the basis of input information about the surroundings of the traffic light installation. The traffic light installation acts as a data pool and can independently reproduce a road section using the information which it has measured or which it has obtained from adjacent vehicles. In addition, the traffic light installation can use the input information to produce meta information which is communicated to other vehicles and thus results in a constant flow of traffic.

15 Claims, 4 Drawing Sheets

TRAFFIC GUIDANCE SYSTEM

CROSS REFERENCE TO RELATED APPLICATIONS

This application is the U.S. national phase of PCT International Application No. PCT/EP2008/060779, filed Aug. 15, 2008, which claims priority to German Patent Application No. 10 2007 041359.0, filed Aug. 30, 2007 and German Patent Application No. 10 2008 037883.6, filed Aug. 15, 2008, the contents of such applications being incorporated by reference herein.

FIELD OF THE INVENTION

The invention relates to traffic-guidance and assistance technology for vehicles. In particular, the invention relates to a traffic light installation, a safety system for a vehicle, a method for producing meta information, a program element and a computer-readable medium.

BACKGROUND OF THE INVENTION

Situations often arise in road traffic in which a driver needs to react in order to prevent an accident. As an example, it may be that there is a broken-down vehicle after a blind bend. As another example, it may be that an emergency vehicle drives through a junction even though the traffic light installation is on red. The situation may also arise in which leaves, loose chippings, oil, black ice or the like critically alter a particular area of a roadway without the possibility of any driver predicting this.

In these or similar situations, the driver must react quickly and in a suitable manner in order to prevent an accident.

SUMMARY OF THE INVENTION

It is an object of the invention to provide increased safety in road traffic.

The invention specifies a traffic light installation, a safety system for a vehicle, a method for producing meta information for increasing safety in road traffic, a program element and a computer-readable medium.

The exemplary embodiments described relate in equal measure to the safety system, the traffic light installation, the method, the program element and the computer-readable medium.

In line with one exemplary embodiment of the invention, a traffic light installation for producing meta information on the basis of input information is specified, wherein the input information relates to the surroundings of the traffic light installation. The traffic light installation is particularly suitable for increasing safety in road traffic and for providing a constant flow of traffic. The traffic light installation has a control unit for producing the meta information on the basis of the input information and also a communication unit for sending the meta information to adjacent vehicles or adjacent traffic light installations, with the meta information being designed to produce a constant flow of traffic.

In other words, the traffic light installation is designed such that it can use the meta information produced by it to ensure that the vehicles traveling in the area of the traffic light installation always have information about the optimum speed. In this way, it is possible to prevent queues, and gas can be saved.

In line with a further exemplary embodiment of the invention, the input information has information which has been sent from a vehicle to the traffic light installation.

In other words, adjacent vehicles can monitor the vehicle surroundings and send appropriate information to the traffic light installation. This information is then analyzed in the traffic light installation and processed further. The result of the further processing is then sent by means of a broadcast to all adjacent vehicles, so that said vehicles can adjust their speeds in optimum fashion as appropriate.

In line with a further exemplary embodiment of the invention, the input information is transmitted to the traffic light installation by means of short-range communication. By way of example, the wireless transmission from the vehicles to the traffic light installation (and back) is effected by means of WiMax, Bluetooth or DSRC (Digital Short Range Communication), or else by means of GSM, UMTS, LTE or WLAN (e.g. 802.11p).

By way of example, the vehicles are a motor vehicle, such as a car, bus or heavy goods vehicle, or else are a rail vehicle, a bicycle or a motorcycle.

In line with a further exemplary embodiment of the invention, the input information contains a piece of information stating that the vehicle is an emergency vehicle (such as an ambulance, police car or fire engine).

In this case, the traffic light installation can change to allow the emergency vehicle free passage at a traffic light junction, for example.

In line with a further exemplary embodiment of the invention, the input information has monitoring data from the surroundings of the traffic light installation which the traffic light installation records using a dedicated sensor system.

For this purpose, the traffic light installation is equipped with one or more cameras, for example, which the traffic light installation can use to determine the density of traffic flow and also the speed of the individual vehicles. Other sensors may also be provided, such as light barriers, which can be used to measure the flow of traffic.

In this way, it is possible for the traffic light installation to effect traffic flow control without being reliant on data from adjacent vehicles for this. On the contrary, the traffic light installation performs all measurements itself. Naturally, the traffic light installation can also evaluate both data records and incorporate them into its calculation (on the one hand the data record which it has measured itself and on the other hand the data which are transmitted from the adjacent vehicles).

In line with a further exemplary embodiment of the invention the meta information contains a speed recommendation for the adjacent vehicles. By way of example, this speed recommendation may be individualized. As an example, a different speed recommendation can be transmitted for the vehicles on a first road than for vehicles which are on another road. This very thing can also apply to different lanes.

In line with a further exemplary embodiment of the invention, the meta information is designed to automatically actuate a driver assistance system or to adjust a speed controller (ACC, Adaptive Cruise Control) in a receiving vehicle.

This ensures that every vehicle is always traveling at the optimum speed without the driver having to intervene for this.

In line with a further exemplary embodiment of the invention, the traffic light installation is a mobile traffic light installation. By way of example, this is understood to mean traffic lights which are temporarily set up at road works or hazard spots.

In line with a further exemplary embodiment of the invention, the traffic light installation has one or more data stores for storing and collecting the input information, wherein the control unit of the traffic light installation is designed to create a digital map about the surroundings of the traffic light installation on the basis of the input information.

In other words, the (mobile) traffic light installation can create its own digital map itself and reproduce the street or the junction on which it is set up itself. This is particularly advantageous for mobile traffic lights which have no or outdated digital maps.

In particular, the traffic light installation is capable of learning by virtue of its using its own measurements and/or using information which is transmitted to it from adjacent vehicles to reproduce the road network in its surroundings.

In line with a further exemplary embodiment of the invention, the control unit is designed to analyze the input information and can take said analysis as a basis for determining whether or not the vehicle is moving toward the traffic lights.

In other words, the control unit can determine whether the vehicle will pass the traffic lights in the near future or is moving on a parallel road, for example.

In line with a further exemplary embodiment of the invention, the communication unit of the traffic light installation is designed to network a plurality of traffic light installations to one another. By way of example, the networking is effected via the Internet using the Internet protocol.

In this way, it is possible for a rescue operation or a selected vehicle to be tracked from one set of traffic lights to the next and to ensure that the relevant traffic lights are always on green. In particular, important information can be passed on from traffic light installation to traffic light installation.

It is therefore possible to produce a self-regulating network of traffic lights which is capable of automatically adjusting an optimum flow of traffic.

In line with a further exemplary embodiment of the invention, a safety system for a vehicle is specified which is designed to communicate with a traffic light installation as described above. The safety system has a communication unit for automatically transmitting information to the traffic light installation and for receiving meta information from the traffic light installation and also a control unit for automatically evaluating the meta information which is sent by the traffic light installation. In addition, the control unit is used to produce a control signal for assisting the driver of the vehicle on the basis of the received meta information.

By way of example, the safety system can receive warning information from the traffic light installation. This warning information may also contain position statements from the hazard spot, for example. In this way, the safety system can decide whether and at what time the warning is to be communicated to the driver or to a driver assistance system in the vehicle, for example. In this context, the direction of movement of the other vehicle is also important. If the other vehicle is an emergency vehicle (such as an ambulance, a police car or a fire engine), for example, which is not moving toward the vehicle but rather away from it, however, or else is on an adjacent road which does not lead to the vehicle, then the warning signal can admittedly be noted by the safety system. Sometimes, however, the safety system decides that no further measures are required.

The control signal which the control unit produces to assist the driver may be an audible signal, a visual signal for display to the driver, an entry in a digital map, a general piece of information or else a control signal for a driver assistance system (or a combination of the aforementioned options), for example.

By way of example, the control signal can be used to make changes to the ABS or ESP settings in the vehicle. By way of example, the standard coefficients of friction for ABS and ESP can be changed. It is also possible to use the control signal to adjust the adjusted cruise control speed or the minimum tolerance for the ACC (Automatic Cruise Control) with respect to vehicles in front.

In line with a further exemplary embodiment of the invention, the warning information which is sent by the traffic light installation contains a piece of information stating that a vehicle is at a standstill or is below a stipulated minimum speed.

In order to decide that warning information needs to be sent, the traffic light installation has an appropriate sensor system which, inter alia, measures the speed of the vehicles and compares it with an average measured speed. If the currently measured speed of the vehicle now drops below a certain minimum value (which may vary from road to road), or if the vehicle is even at a standstill on the road, an appropriate piece of warning information is sent together with the vehicle position. This signal can be received by the adjacent vehicles, whereupon the drivers are warned (visually or audibly) and possibly control signals are generated for the driver assistance units in order to prevent an accident.

The warning for the individual drivers can be provided visually (using an appropriate display), audibly and/or else haptically (for example in the form of the seat or steering wheel vibrating), for example. An entry can also be made in a digital map in the vehicle which records the information and the location of the hazard spot.

The term "digital map" is also intended to be understood to mean maps for advanced driver assistance systems (ADASs) without any navigation taking place.

In addition, it should be pointed out that, within the context of the present invention, GPS is representative of all global navigation satellite systems (GNSS), such as GPS, Galileo, GLONASS (Russia), Compass (China), IRNSS (India) D etc.

In line with a further exemplary embodiment of the invention, a method for producing meta information on the basis of input information about the surroundings of a traffic light installation is specified in which input information is produced, meta information is produced on the basis of the input information by the traffic light installation, and the meta information is sent to adjacent vehicles. This meta information is used for producing a constant flow of traffic in the surroundings of the traffic light installation.

In this way, it is possible to increase road safety. In addition, gas can be saved, since the vehicles move along at optimum speed.

In line with a further exemplary embodiment of the invention, a program element is specified which, when executed on a processor in a traffic light installation, instructs the processor to perform the steps described above.

In line with a further exemplary embodiment of the invention, a computer-readable medium is specified which stores a program element which, when executed on a processor in a traffic light installation, instructs the processor to perform the method steps specified above.

In this case, the program element may be part of a piece of software, for example, which is stored on a processor in the traffic light installation. The processor may likewise be the subject matter of the invention. In addition, this exemplary embodiment of the invention comprises a program element which uses the invention right from the outset, and also a program element which prompts an existing program to use the invention by virtue of an update.

Preferred exemplary embodiments of the invention are described below with reference to the figures.

Figure 1:
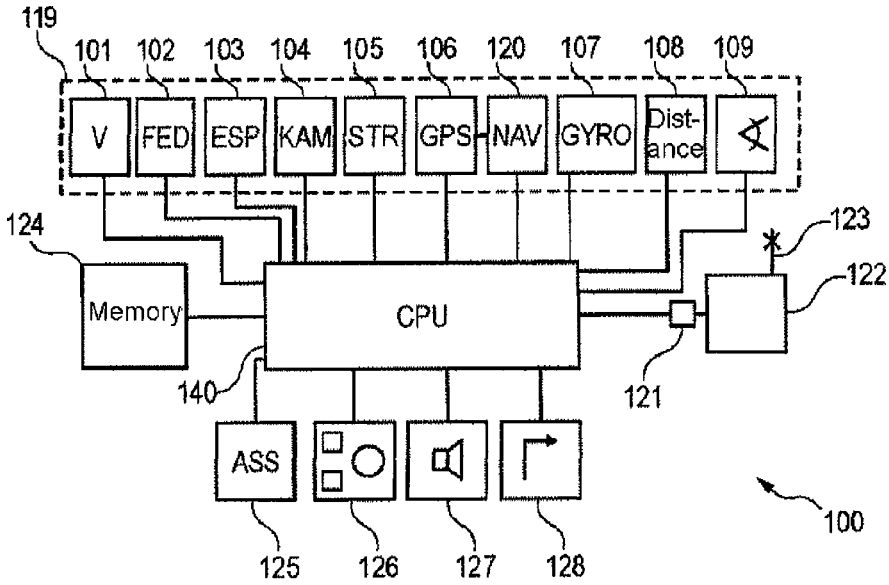
FIG. 1 shows a schematic illustration of a safety system based on an exemplary embodiment of the invention.

The illustrations in the figures are schematic and not to scale.

DETAILED DESCRIPTION OF THE PREFERRED EMBODIMENTS

In the description of the figures which follows, the same reference numerals are used for the same or similar elements.

FIG. 1 shows an illustration of components of a safety system 100 which is installed in a vehicle, for example. The safety system 100 has a control unit 140, a communication unit 122 with an antenna 123, and a position-finding unit 106.

The data to be sent, which are transmitted from the control unit 140, which is in the form of a CPU, for example, to the communication unit 122, can be encrypted by means of an encryption device 121. Similarly, the received data, which are transmitted from the communication unit 122 to the control unit 140, can be decrypted by the decryption unit 121.

In this way, it is possible to reduce the risk of misuse. In particular, this makes it possible to ensure that information is only used by vehicles which have actually installed an appropriate safety system.

The control unit 140 has an input unit 126 connected to it. The input unit 126 allows various adjustments to be made for the safety system 100 and possibly on a navigation unit 120 linked thereto.

In addition, a visual output unit in the form of a monitor 128 is provided which can be used to output routing information, for example. Furthermore, the routing information can also be output via the audible output unit 127. Besides the routing information, it is also possible to output warning advice to the driver. Output via the audible output unit 127 has the advantage that the driver is less distracted from what is currently happening in the traffic.

A memory element 124, which is connected to the control unit 140 or is integrated in the control unit 140, stores the digital map data (e.g. as navigation map data) in the form of data records, and, by way of example, the memory element 124 also stores additional information about traffic restrictions, infrastructure devices (traffic light installations, etc.) and the like in association with the data records.

In addition, a driver assistance system 120 is provided which is supplied with the digital map data and, by way of example, also with the meta information sent by the traffic light installation (e.g. warning information, position statements and a recommended speed) and also sensor information measured by the driver's own vehicle.

For the purpose of determining the current vehicle position, the safety system 100 has a navigation unit 120 with a satellite navigation receiver 106 which is designed to receive positioning signals from Galileo satellites or GPS satellites, for example. Naturally, the satellite navigation receiver 126 may also be designed for other satellite navigation systems.

The satellite navigation receiver 106 is connected to the control unit 140. The navigation unit 120 is also connected to the control unit 140. Furthermore, there is a direct connection between the navigation unit 120 and the satellite navigation receiver 106. It is therefore possible for the GPS signals to be transmitted directly to the CPU 140.

Since the positioning signals cannot always be received in city centers, for example, the sensor system 119 of the communication device 100 also has a direction sensor 107, a distance sensor 108, a steering wheel angle sensor 109, a spring excursion sensor 102, an ESP sensor system 103 and possibly a visual detector 104, for example in the form of a camera, for the purpose of performing compound navigation. It is also possible for a beam sensor 105 (radar or lidar sensor) to be provided. In addition, the sensor system 119 has a speedometer 101.

The signals from the GPS receiver 106 and the other sensors are handled in the control unit 140. The vehicle position ascertained from said signals is aligned with the road maps using map matching. The routing information obtained in this manner is finally output via the monitor 128.

Figure 2:
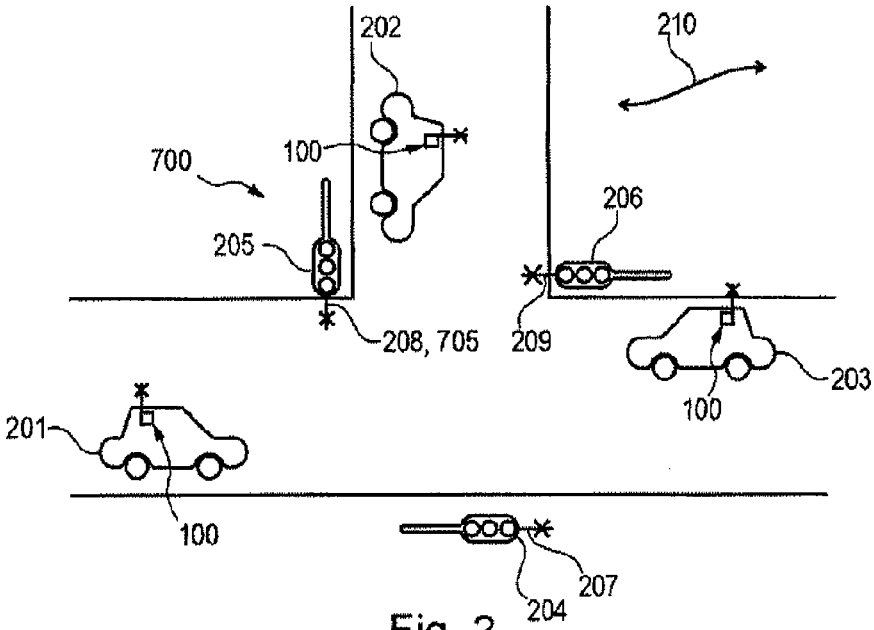
FIG. 2 shows an illustration of a traffic light installation and of vehicles based on an exemplary embodiment of the invention.

FIG. 2 shows a traffic light installation 700 with three sets of traffic lights 204, 205, 206. The three sets of traffic lights each have a dedicated transmission and reception device with an appropriate computation unit 207, 208, 209. The traffic lights or even a plurality of traffic light installations may be also be connected to a central computation unit which also has a central transmission and reception unit. An appropriate electronics unit is shown in more detail in FIG. 7.

Each of the three vehicles shown 201, 202, 203 have a dedicated safety system 100 which is integrated in the vehicle.

The vehicles communicate with one another and with the traffic light installation using a wireless communication link 210.

By way of example, the vehicle 203 is a stationary vehicle which has been involved in an accident. By way of example, the vehicle 202 is an emergency vehicle which is on the way to the accident location. By way of example, the vehicle 201 is a normal road user who cannot see the accident spot and is also unaware of the approaching emergency vehicle.

The safety system 100 in the vehicle 203 informs the adjacent vehicles that said vehicle had a collision and has come to a standstill in the middle of the roadway. The driver of the vehicle 201 and also the driver of the emergency vehicle 202 are notified of this. The relevant driver assistance systems of the two adjacent vehicles 201, 202 are also notified as appropriate, so that they can intervene if the drivers do not do so.

The emergency vehicle 202 approaches the traffic light installation 204, 205, 206 and sends an appropriate signal to the traffic light installation, whereupon the traffic lights 205 are changed to green and the traffic lights 204 and 206 are changed to red, so that the vehicle 202 can go through the junction unhindered. The traffic light circuit informs the safety system in the vehicle 201 in good time, so that it can adjust the speed of the vehicle 201 in optimum fashion (so that the driver of the vehicle 201 does not need to stop or slow down the car, for example, because it is approaching the traffic lights slowly enough to maintain the flow of traffic).

Figure 3:
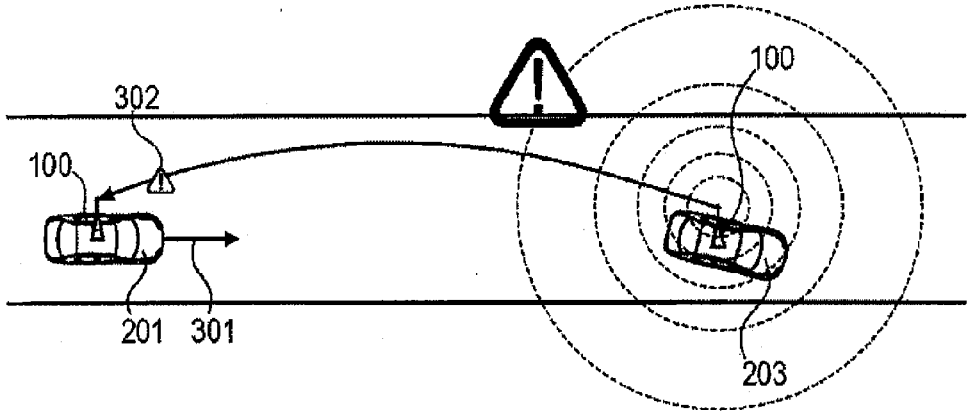
FIG. 3 shows two vehicles based on an exemplary embodiment of the invention.

FIG. 3 shows two vehicles 201, 203 which are each equipped with a safety system 100. The stationary vehicle 203 transmits its position with an appropriate warning 302 to the approaching vehicle 201. The vehicle 201 moving in direction 301 receives the warning signal and sends an appropriate warning to the driver (for example in the form of a visual sign and also an entry in the digital map). The driver assistance unit is also informed as appropriate at the same time, so that it can intervene in the driving.

Figure 4:
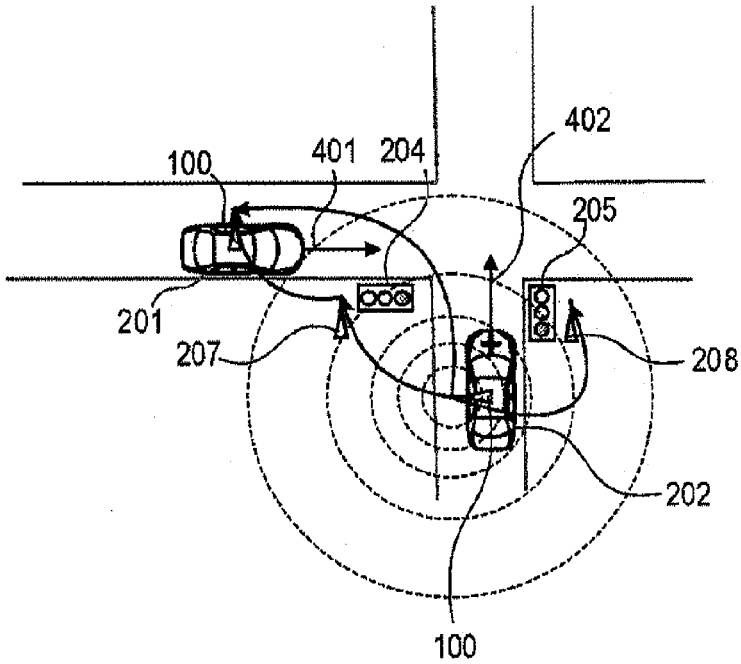
FIG. 4 shows a traffic light installation with two vehicles based on a further exemplary embodiment of the invention.

FIG. 4 shows two vehicles 201, 202 which are approaching a junction. The vehicle 202, which is an emergency vehicle, uses its safety system 100 to send the signal indicating that it is an emergency vehicle.

Since the two vehicles 201, 202 are moving toward one another at right angles in the directions 401 and 402, respectively, the vehicle 201 needs to reduce its speed in order to prevent an accident.

This can be done fully automatically by virtue of firstly the emergency vehicle 202 controlling the traffic light installation 204, 205 as appropriate and secondly the vehicle 201 receiving information, both from the emergency vehicle 202 and from the traffic light installation, on the basis of which it can adjust its speed in optimum fashion.

The vehicle 201 can then display an alarm and information about the direction from which the emergency vehicle is coming, and adds this information to the digital map. The traffic lights transmit their status to both vehicles. The two vehicles can react to the traffic light status as appropriate and display it in the digital map.

Figure 5:
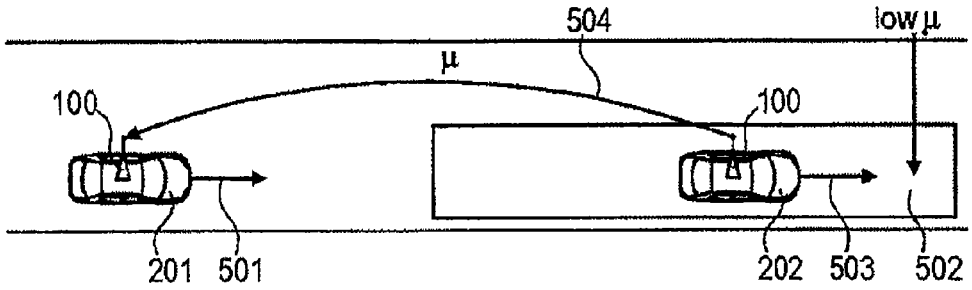
FIG. 5 shows two vehicles based on a further exemplary embodiment of the invention.

FIG. 5 shows two vehicles 201, 202 which each have a safety system 100. Both vehicles are moving at different speeds in the same direction 501 and 503, respectively.

The vehicle 202 in front is in an area 502 with a low coefficient of friction. This is sensed by the vehicle sensor system, and an appropriate warning signal with a position statement 504 is transmitted to the vehicle 201 behind. In particular, information about the state of the road is transmitted.

The state of the road surface is detected by an ABS braking maneuver, for example. If the detected information is classified as critical (it is thus possible for the detected data to be analyzed in the vehicle 202 in front), an appropriate warning signal with a position statement is sent and is received by the vehicle 201 behind.

The vehicle 201 behind then reacts by triggering an alarm in the form of a visual signal, for example, or by virtue of the gas pedal being depressed a long way by the vehicle electronics unit. In addition or alternatively, an audible signal can be output. Furthermore, the standard coefficients of friction for ABS or ESP can be changed. It is also possible for the set speed and/or the set distance for ACC to be changed. Naturally, the position of the hazard spot 502 can also be entered in the digital map.

Figure 6:
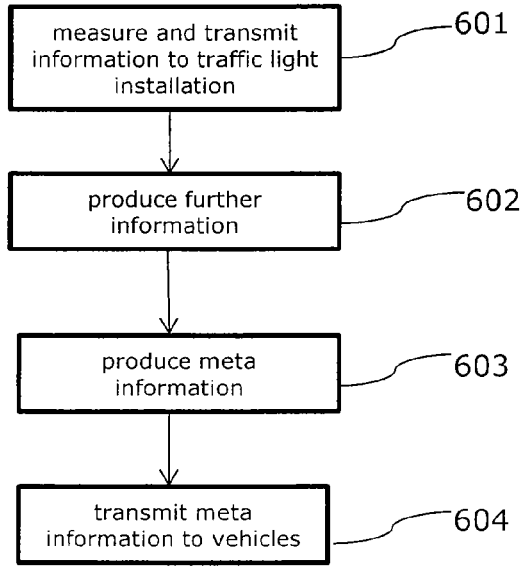
FIG. 6 shows a flowchart for a method based on an exemplary embodiment of the invention.

FIG. 6 shows a flowchart for a method based on an exemplary embodiment of the invention. In step 601, input information is measured by an adjacent vehicle and is transmitted to the traffic light installation. In step 602, the traffic light installation produces further input information by means of its own measurements. In step 603, the traffic light installation produces meta information on the basis of the input information and, in step 604, sends the meta information to adjacent vehicles, wherein the meta information is designed to produce a constant flow of traffic.

Figure 7:
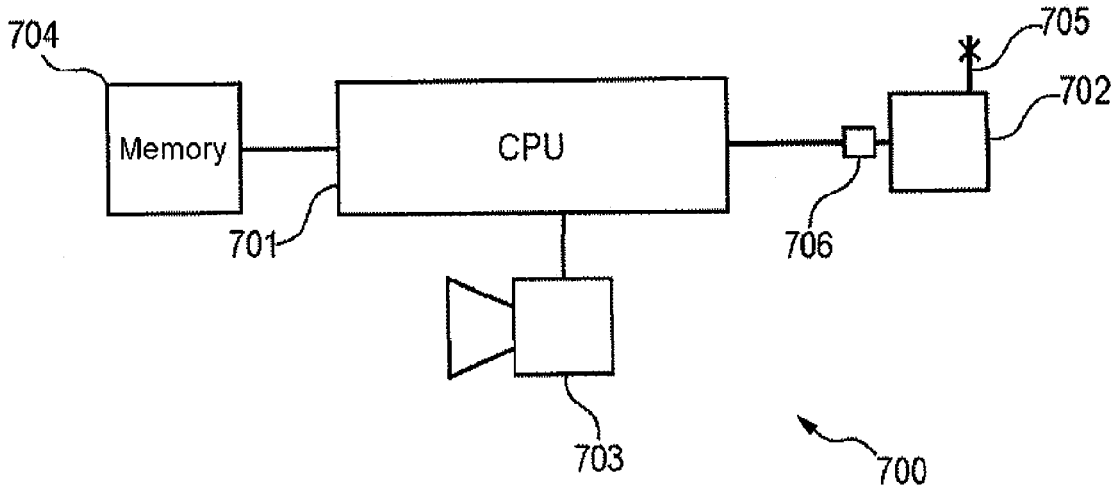
FIG. 7 shows an illustration of components of a traffic light installation based on an exemplary embodiment of the invention.

FIG. 7 shows a schematic illustration of components 700 of a traffic light installation. The components shown in FIG. 7 can be installed in every single set of traffic lights in the traffic light installation or in a central set of traffic lights or a central station (external to the traffic lights).

The components have a control unit 701, which is in the form of a CPU, for example, a memory 704, a sensor system in the form of a camera or radars 703, and also a communication unit 702 with an antenna 705 and a coding device 706.

In this case, the coding device 706 corresponds to the coding device 121 in FIG. 1 for the vehicle safety system 100.

The other elements (memory, control unit 701, sensor system 703 and communication unit 702) may also be designed like the corresponding components in the vehicle safety system 100 (memory 124, CPU 140, communication unit 122, camera 104).

The control unit 701 for the traffic light installation firstly controls the signal change for the traffic light installation. Secondly, the control unit 701 produces the meta information which is sent to the adjacent vehicles via the communication unit 702.

The encryption device 706 can be used to ensure that the vehicles only note meta information from verified traffic light installations. Improperly transmitted data are identified and rejected.

In order to assign an emergency vehicle or another vehicle to a particular arm of the junction, a direction-based algorithm is used, for example, in particular, the control unit 701 for the traffic light installation can also perform a learning algorithm which generates a digital map of the surroundings by communicating with civil road users. Following the learning process, the assignment is made on the basis of the learnt map, which allows correct operation even in the case of very specific junction scenarios.

The traffic light installation observes the traffic in its surroundings. For the purpose of the observation, ambient sensors such as cameras or radar are used. It is also possible to use the information from other vehicles, which is sent to the traffic light installation using vehicle-to-infrastructure communication (C2X).

If a particular friction value is detected in the surroundings of the traffic light installation and transmitted by C2X, for example, the traffic light installation buffers this friction value and passes it on again as soon as a further vehicle approaches. A similar practice is also possible with other events.

Equally, it is possible to infer possible friction values from the speed of the vehicles which are traveling past. If the vehicles are traveling significantly slower than the road class and the traffic density would permit, it is possible to infer a lower friction value or other poor weather conditions. This information can then be passed on to the other vehicles or adjacent traffic light installations using short-range communication (C2X).

Since the traffic light installation observes the flow of traffic over a relatively long period, it can ascertain the average traffic flow density. If this results in discrepancies toward a lower speed and these cannot be attributed to a higher vehicle density, it is possible to infer a hazard spot. This information can then be transmitted by C2X.

The information obtained can be used to derive speed recommendations. It is thus possible, by way of example, to forward the average speed in the area under consideration as a recommendation too, in which case legal regulations must be observed. This means that no speeds which are not permitted are recommended. When hazard spots are identified too, it is possible to recommend the speed at which other vehicles in this area are traveling. The recommendation can either be passed on by means of C2X or can be displayed on a sign for an infrastructure unit. By way of example, this recommendation can then be set directly in an ACC in a receiving vehicle or indicated to the driver.

The use of information which is sent to the traffic light installation by parking vehicles or vehicles in a queue, for example, allows the ascertainment of information which can be used for optimum regulation of the flow of traffic, without the need to set up additional infrastructure units for this purpose. This allows a reduction in the density of the infrastructure units.

Further exemplary embodiments of the invention are described below:

FIRST EXAMPLE

A vehicle is in a queue but can use its camera and its radar to observe the oncoming traffic. The vehicle can use these sensors to ascertain the average speed in the opposite lane and passes on this average speed to the traffic light installation by C2X as a recommendation. If the measured average speed of the oncoming traffic suddenly changes, the vehicle sends a warning to the traffic light installation.

The traffic light installation can then use these data to produce and send suitable meta data for adjacent vehicles.

SECOND EXAMPLE

An infrastructure unit (for example a traffic light installation) uses cameras to ascertain the traffic density and the average speed at a point and passes on this information by C2X. These data are stored in the infrastructure unit over a relatively long period. On one day, a significant discrepancy from these stored and hence typical values arises. In this case, the traffic light installation sends a warning (meta information) to the adjacent vehicles, since it can be assumed that there is a hazard spot. Similarly, a recommended maximum speed is sent to the individual vehicles.

THIRD EXAMPLE

An infrastructure unit observes the speed of the vehicles at a point. In addition, it is known that the maximum speed on the basis of construction may be at this point (e.g., a bend). If discrepancies in the maximum speed at this point now arise which cannot be attributed to the flow of traffic and additionally last for a relatively long period (for example several minutes), a relatively low friction value can be assumed and the infrastructure unit (traffic light installation) sends a warning.

FOURTH EXAMPLE

A vehicle is parked in a parking lot. However, the C2X unit of the vehicle continues to be supplied with power and receives the positions, speeds, etc. of the passing vehicles. From these, the C2X unit ascertains an average speed, detects discrepancies and hence hazards, etc., and passes on this information. If the supply voltage drops below a previously stipulated level, the previously ascertained information is sent one last time. It is also indicated that this is a final transmission. In this case, internal variables, as are necessary for recursive calculation with an average speed, for example, are also sent. Other parking vehicles (or traffic light installations) can then use said information to continue the ascertainment. There is thus the assurance that even when parking cars (or cars in a queue or at alternating traffic light installations) change, the information can be ascertained virtually statically and hence an infrastructure unit can be replaced. Instead of a parking vehicle, it is also possible to use a mobile traffic light installation, for example.

In addition, it should be pointed out that "comprising" and "having" do not exclude other elements or steps, and "a" or "an" do not exclude a large number. Furthermore, it should be pointed out that features or steps which have been described with reference to one of the above exemplary embodiments can also be used in combination with other features or steps from other exemplary embodiments described above.

The invention claimed is:

1. A traffic light installation for producing meta information on a basis of input information about surroundings of the traffic light installation, said traffic light installation comprising:

a control unit for producing the meta information on the basis of the input information, the input information collected by vehicles on the roadway and indicating traveling conditions on the roadway;

a communication unit for sending the meta information to other vehicles on the roadway;

wherein the meta information is configured to produce a constant flow of traffic on the roadway by informing drivers of the other vehicles of the traveling conditions on the roadway.

2. The traffic light installation as claimed in claim 1, wherein the input information has information which is sent from a vehicle to the traffic light installation.

3. The traffic light installation as claimed in claim 1, wherein the input information is transmitted to the traffic light installation by short-range communication.

4. The traffic light installation as claimed in claim 1, wherein the input information contains a piece of information stating that a vehicle is an emergency vehicle.

5. The traffic light installation as claimed in claim 1, wherein the input information has monitoring data from surroundings of the traffic light installation which the traffic light installation records using a dedicated sensor system.

6. The traffic light installation as claimed in claim 1, wherein the meta information contains a speed recommendation for the other vehicles.

7. The traffic light installation as claimed in claim 1, wherein the meta information is configured to automatically actuate a driver assistance system or to adjust an Adaptive Cruise Control (ACC) of a receiving vehicle.

8. The traffic light installation as claimed in claim 1, wherein the traffic light installation is a mobile traffic light installation.

9. The traffic light installation as claimed in claim 1, also comprising:

a data store for storing and collecting the input information;

wherein the control unit is configured to create a digital map about the surroundings of the traffic light installation on the basis of the input information.

10. The traffic light installation as claimed in claim 1, wherein the control unit is configured to analyze the input information and take the analysis as a basis for determining whether the vehicle is moving toward the traffic light.

11. The traffic light installation as claimed in claim 1, wherein the communication unit is configured to network a plurality of traffic light installations to one another.

12. A safety system for a vehicle for communication with a traffic light installation as claimed in claim 1, said safety system comprising:

a communication unit for automatically transmitting information to the traffic light installation and for receiving meta information from the traffic light installation;

a control unit for automatically evaluating the meta information which is sent by the traffic light installation;

wherein the control unit is also configured to produce a control signal for assisting a driver of the vehicle on the basis of the meta information.

13. A program element which, when executed on a processor in a traffic light installation as claimed in claim 1, instructs the processor to perform the following steps:

production of input information;

production of meta information on the basis of the input information by the traffic light installation; and sending the meta information to adjacent vehicles, wherein the meta information is configured to produce a constant flow of traffic.

14. A computer-readable medium which stores a program element which, when executed on a processor in a traffic light installation as claimed in claim 1, instructs the processor to perform the following steps:

production of input information;

production of meta information on the basis of the input information by the traffic light installation; and sending of the meta information to adjacent vehicles, wherein the meta information is configured to produce a constant flow of traffic.

15. A method for producing meta information on the basis of input information about surroundings of a traffic light installation, said method having the following steps:

producing input information;

producing, by the traffic light installation, meta information on the basis of the input information, the input information collected by vehicles on the roadway and indicating traveling conditions on the roadway; and sending, by the traffic light installation, the meta information to other vehicles on the roadway, wherein the meta information is configured to produce a constant flow of traffic on the roadway by informing drivers of the other vehicles of the traveling conditions on the roadway.

* * * * *